US007194881B2

(12) United States Patent
Kutschat

(10) Patent No.: US 7,194,881 B2
(45) Date of Patent: Mar. 27, 2007

(54) CLOSURE PANEL LOCK AND OPENER HANDLE

(75) Inventor: Horst Kutschat, Wuppertal (DE)

(73) Assignee: D. La Porte Sohne GmbH, Wuppertal (DE)

( * ) Notice: Subject to any disclaimer, the term of this patent is extended or adjusted under 35 U.S.C. 154(b) by 0 days.

(21) Appl. No.: 11/063,345

(22) Filed: Feb. 25, 2005

(65) Prior Publication Data

US 2005/0279144 A1 Dec. 22, 2005

(51) Int. Cl.
*E05B 37/10* (2006.01)

(52) U.S. Cl. ..... 70/224; 70/257; 70/278.7; 70/279.1; 70/360; 292/336.3; 292/DIG. 37

(58) Field of Classification Search ..... 70/210, 70/207, 213–217, 256, 278.1, 284, 285, 279.1, 70/257, 277, 278.7, 208, 224, 188, 189, 360, 70/472, 149, 218, 222, 422, 278.3; 292/DIG. 25, 292/DIG. 23, DIG. 37, 336.3
See application file for complete search history.

(56) References Cited

U.S. PATENT DOCUMENTS 2,358,554 A * 9/1944 Bixel ..... 70/215
3,036,453 A * 5/1962 Dubonnet ..... 70/207
4,073,170 A * 2/1978 Miyabayashi et al. ..... 70/256
4,886,310 A * 12/1989 Cyr et al. ..... 292/336.3
4,936,122 A * 6/1990 Osada ..... 70/214
5,040,390 A * 8/1991 Mistry et al. ..... 70/241
6,240,751 B1 * 6/2001 Marzolf et al. ..... 70/207
6,588,813 B1 * 7/2003 Marcarini et al. ..... 292/347
2002/0157436 A1 * 10/2002 Klein ..... 70/257
2002/0189307 A1 * 12/2002 Gokcebay et al. ..... 70/278.3
2003/0029210 A1 * 2/2003 Budzynski et al. ..... 70/278.1
2003/0122556 A1 * 7/2003 Sueyoshi et al. ..... 324/686
2005/0231364 A1 * 10/2005 Nitawaki et al. ..... 340/545.4

* cited by examiner

*Primary Examiner*—Lloyd A. Gall
(74) *Attorney, Agent, or Firm*—Brinks Hofer Gilson & Lione

(57) ABSTRACT

The invention relates to an actuating apparatus for a lock mechanism, in particular of a door or panel of a motor vehicle having a handle body, in which an actuating device for driving an actuating element for the lock mechanism is mounted in a handle-body end region. A moveable coupling link is provided, with which the actuating device can be brought out of operation, the coupling link being connected driveably to a locking device having a remote-controllable driving device.

44 Claims, 10 Drawing Sheets

CLOSURE PANEL LOCK AND OPENER HANDLE

CROSS REFERENCE TO RELATED APPLICATION

This application claims priority to DE 10 2004 009 366.0, filed Feb. 26, 2004.

BACKGROUND OF THE INVENTION

The invention relates to an actuating apparatus for a lock, in particular a door lock and/or panel lock of a motor vehicle or tractor.

SUMMARY OF THE INVENTION

Known actuating apparatuses for motor vehicle locks have a handle body, in which a pushbutton with a movable lock cylinder is mounted. The pushbutton can be transferred from a first operating state into a second operating state and vice versa by means of a key which fits into the lock cylinder. In the first operating state, a lock can be actuated by means of the pushbutton, so that it opens. In the second operating state, the pushbutton, when actuated, executes an "empty stroke", so that despite the button being pressed, an actuation, i.e. an opening of the lock, does not occur. The associated motor vehicle door or motor vehicle flap is therefore locked.

Furthermore, it is known to enable the locks to interact with a remote-controllable locking unit, for example within the context of a central locking system of the motor vehicle. In the case of known arrangements of actuating apparatus and lock together with a remote-controllable locking unit, it is disadvantageous that a large amount of space is necessary and a multiplicity of parts and a high structural outlay are required. Furthermore, it is expensive and laborious to install and secure the components.

It is the object of the invention to provide an actuating apparatus for a lock, in particular a motor vehicle door lock or panel lock, in particular for a tractor, which does not need much space and has a remote-controllable locking and/or unlocking functionality.

This object is achieved by an actuating apparatus having the features of claim 1. Advantageous embodiments are indicated in the subclaims which are dependent thereon.

BRIEF DESCRIPTION OF THE DRAWINGS

The invention is described below by way of example with reference to the drawing, in which.

DETAILED DESCRIPTION OF THE INVENTION

Figure 1:
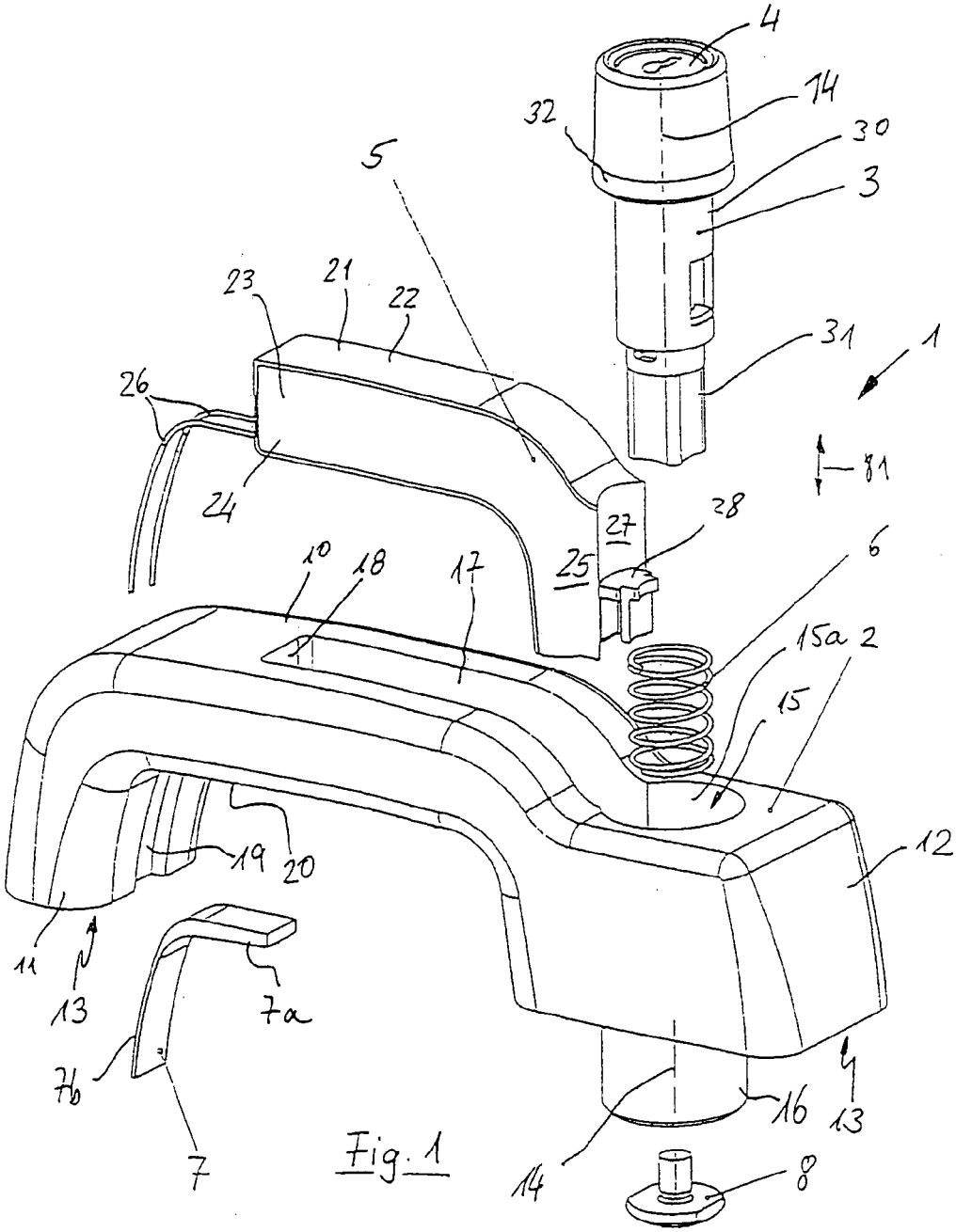
FIG. 1 shows a perspective exploded illustration of an actuating apparatus according to the invention.
Figure 2:
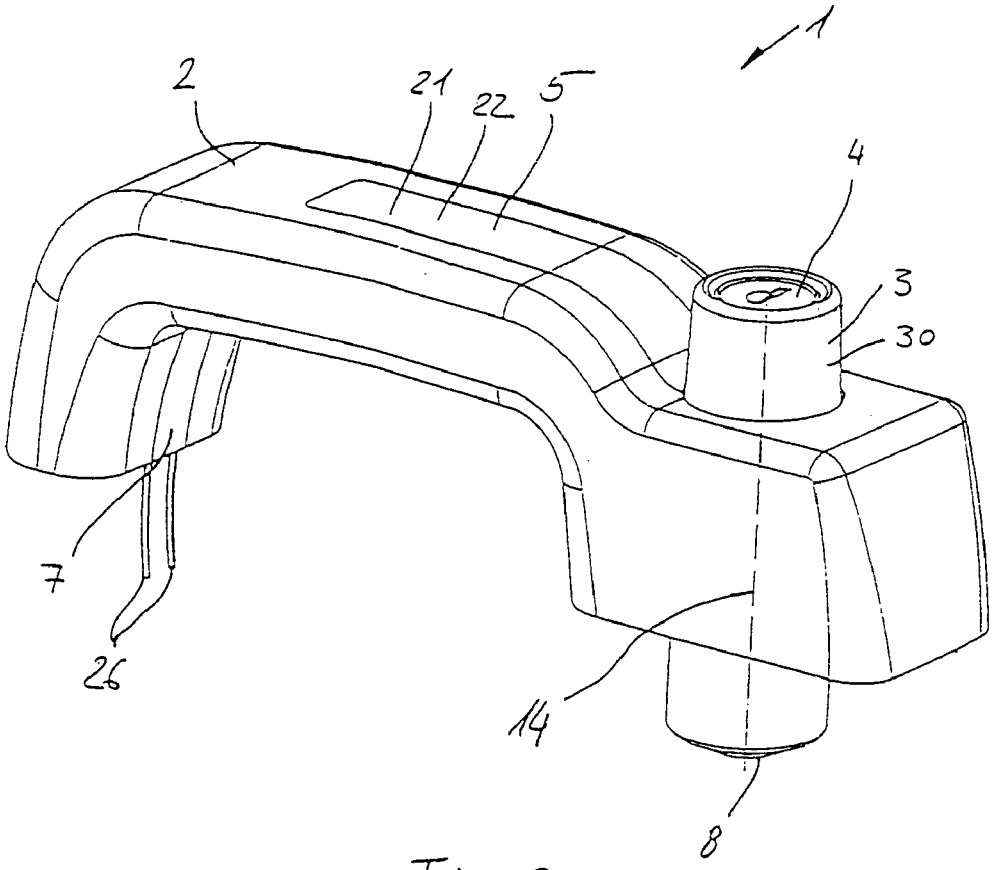
FIG. 2 shows the actuating apparatus according to FIG. 1 in a perspective assembly illustration.

As shown in FIG. 1, an actuating apparatus 1 according to the invention has a handle body 2, and as actuating device a pushbutton 3 with a lock cylinder 4, a motor-driveable locking device 5, a compression spring 6, and a covering 7 and an actuating element 8.

As viewed from the side, the handle body 2 is designed as an essentially U-shaped handle bracket, with a base limb 10, a first U-limb 11 and a second U-limb 12. The U-limbs 11, 12 each have end sides 13 with which the handle body 2 can be fastened, for example, to a door outer skin of a motor vehicle. The second U-limb 12 has, along an actuating longitudinal axis 14, which extends in the limb direction and is also the longitudinal movement axis of the pushbutton 3 together with the lock cylinder 4, a plug-in opening 15 for the pushbutton 3. The plug-in opening 15 opens into a plug-in channel 15*a* which completely penetrates the second U-limb 12. A bushing-shaped receiving device 16 which has an essentially cylindrical outer shape extends from the end side 13 of the second U-limb 12. An elongate groove or a blind-hole recess 17 extends away from the plug-in opening 15, and opening into the latter and to the outside, to over approximately ⅔ of the base limb 10, said elongate groove or blind-hole recess 17 following the contour of the U-limb 12 and of the base limb 10. The blind-hole recess 17 in the base limb 10 is connected in the region of its end 18 lying opposite the plug-in opening 15, just above its groove base, to a groove-type depression 19 or a groove, which is open opposite or extends from an inside 20 of the base limb 10 and of the first U-limb 11 as far as the end side 13 of the first U-limb 11, or said blind-hole recess 17 follows the contour of these parts. The groove-type depression 19 can be covered or can be closed by means of the covering 7, which is essentially an L-shaped design with a first covering limb 7*a* and a second covering limb 7*b*.

The locking device 5 is designed in the manner of a plug-in module for plugging into the blind-hole recess 17 of the handle body 2 and has a cross-sectionally rectangular housing 21 with a housing main part 22 and a lateral housing cover 23. As viewed from the side, the housing 21 is of essentially an L-shape design and has a longer first L-limb 24 and a shorter second L-limb 25. The first L-limb 24 corresponds to the blind-hole recess 17 in the base limb 10. The second L-limb 25 corresponds to the blind-hole recess 17 in the region joining the latter to the plug-in opening 15, and, in the assembled state, comes to lie in the transition region between the second U-limb 12 and the base limb 10. Electric lines 26 lead off at the free end of the first L-limb 24. The second L-limb 25 has, toward the plug-in opening 15, an outer surface 27 which is designed in the shape of a section of a concave cylinder, such that the plug-in opening 15 together with the outer surface 27 is circular in cross section. A projecting slide 28, which is described in more detail further below, projects from the outer surface 27 of the locking device 5 for a distance into the plug-in opening 15.

The pushbutton 3 has a pushbutton upper part 30 and a pushbutton lower part 31. The lock cylinder 4 sits in the pushbutton upper part 30 by means of a clip connection. A sealing ring 32 which interacts with the inside of the plug-in opening 15 and seals off the gap between the pushbutton upper part 30 and the plug-in opening 15 is arranged on the outside of the pushbutton upper part 30.

In the following, the construction of the pushbutton 3, which together with the actuating element 8 forms an actuating device, together with the lock cylinder 4 will be described in more detail with reference to FIGS. 3 and 4. The pushbutton upper part 30 has a cylindrical tube section 32*a* and a compressive part 33. The cylindrical tube section 32*a* is a thin-walled, cylindrical tube with an outside tube 34 and a free annular end surface 35. Opposite the annular end surface 35, the compressive part 33 is connected integrally to the cylindrical tube section 32*a*. The compressive part 33 is larger in outside diameter than the cylindrical tube section 32*a* and has a stepped hole 36 with the actuating longitudinal axis 14 as the central axis. The stepped hole 36 has longitudinal grooves 37 on the inside for receiving small lock plates of the lock cylinder 4. On the outer circumference, the compressive part 33 has, adjacent to the cylindrical tube section 32*a*, an annular groove 38 for receiving the sealing ring 32.

The cylindrical tube section 32*a* has opposite, rectangular window-type cutouts 40 with a lower edge 41, two side edges 42 and an upper edge 43. The two window-type cutouts 40 have the same extent in terms of area. The lower edge 41 and the upper edge 43 are each parallel to the annular end surface 35. The side edges 42 are parallel to the actuating longitudinal axis 14.

The lock cylinder 4 has a blocking body 50 and a rotating body 51*a*. Small lock plates 51 are mounted in a known manner in the blocking body 50. Furthermore, the blocking body 50 has a tumbler 52 as a means of securing it against falling out, said tumbler 52 being intended in a known manner to prevent the blocking body 50 from rotating in the compressive part 33. The rotating body 51 has, eccentrically with respect to the actuating longitudinal axis 14, an eccentric nipple 53 which protrudes downward for a distance in the axial direction from the rotating body 51.

The pushbutton lower part 31 has a punch section 60 and a tube section 61. The punch section 60 has, along the actuating longitudinal axis 14, at a free end 62 of the punch section 60, a threaded hole 63 for receiving the actuating element 8. The tube section 61 has an outside diameter which corresponds to the inside diameter of the cylindrical tube section 32*a* of the pushbutton upper part 30. The tube section 61 extends away for a distance from the punch section 60 and, corresponding to the window-type cutouts 40, has latching projections 64 which are dimensioned, with regard to their three-dimensional shape, in such a manner that they can interact in a latching manner with the lower edge 41 of the window-type cutouts 40. With regard to the width, the latching projections 64 are dimensioned in such a manner that they can be moved up and down in the window-type cutouts 40 guided by the side edges 42. Adjacent to the latching projections 64, the tube section 61 has end steps 65 situated somewhat lower down. The end steps 65 serve to support a slide guide 66 which is described in more detail further below. Aligned in the longitudinal direction, one of the latching projections 64 has a stop tab or stop web 67 as an extension of the tube section 61 upward. The stop tab 67 has a three-dimensional shape in the form of a section of a cylindrical tube wall, and has an upper, free end edge 68 and side edges 69. Directly in the longitudinal axial direction 14, adjacent to the associated latching projection 64, the stop tab 67 has an outwardly projecting, curved stepped shoulder 70 which has a step upper side 71 in the form of a section of a circular ring. As shown in FIG. 4, the assembly of the pushbutton upper part 30 and of the pushbutton lower part 31, the stepped shoulder 70 is situated in one of the window-type cutouts 40 of the pushbutton upper part 30. The axial extent of the stop tab 67 is dimensioned in such a manner that, in the assembly, when the latching projection 64 bears against the lower edge 41 of the window 40, there is an axial distance between the free end edge 68 and the upper edge 43, so that a clearance or gap 72 is formed.

Figure 3:
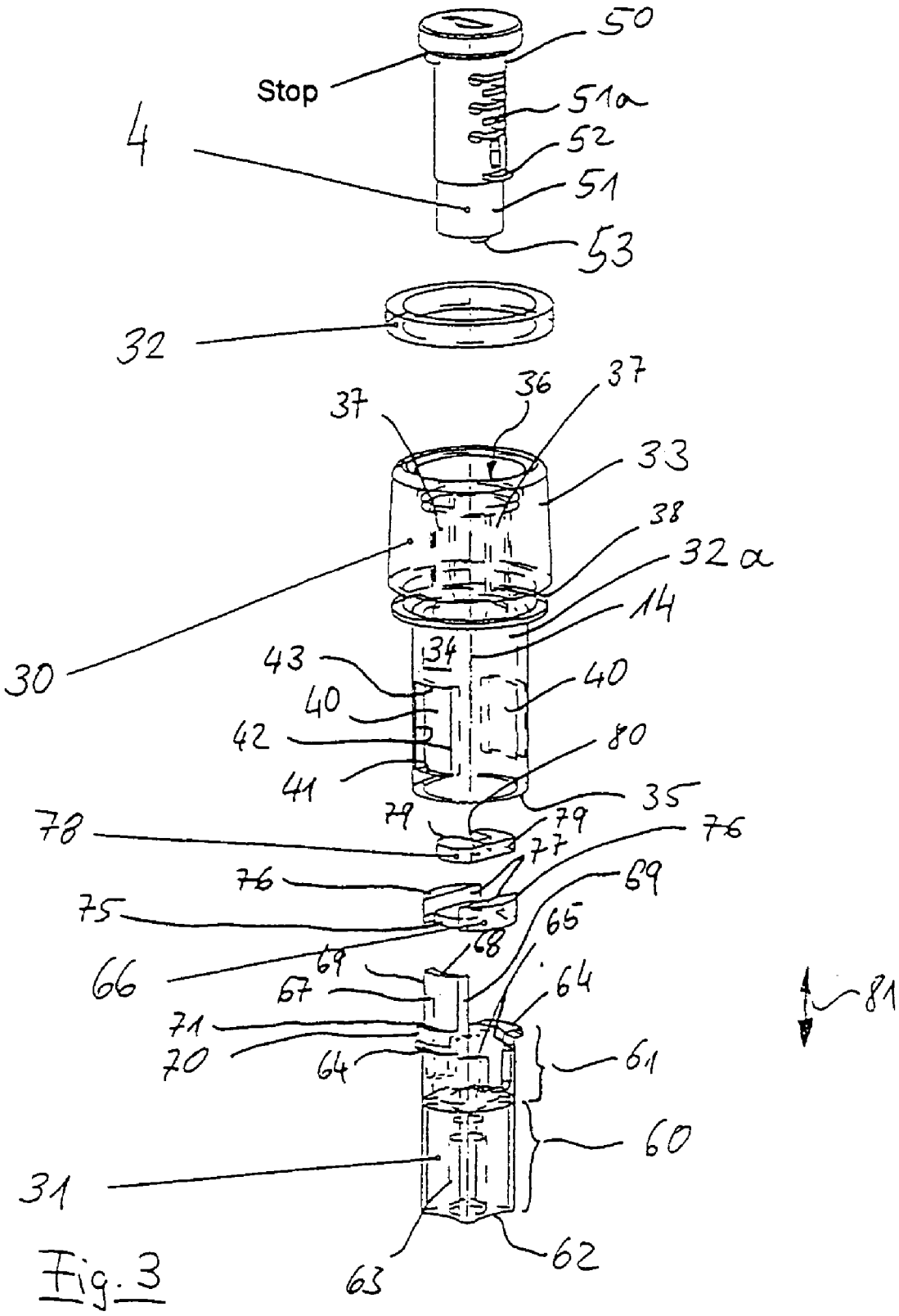
FIG. 3 shows a perspective exploded illustration of a pushbutton of the actuating apparatus according to FIG. 1.
Figure 4:
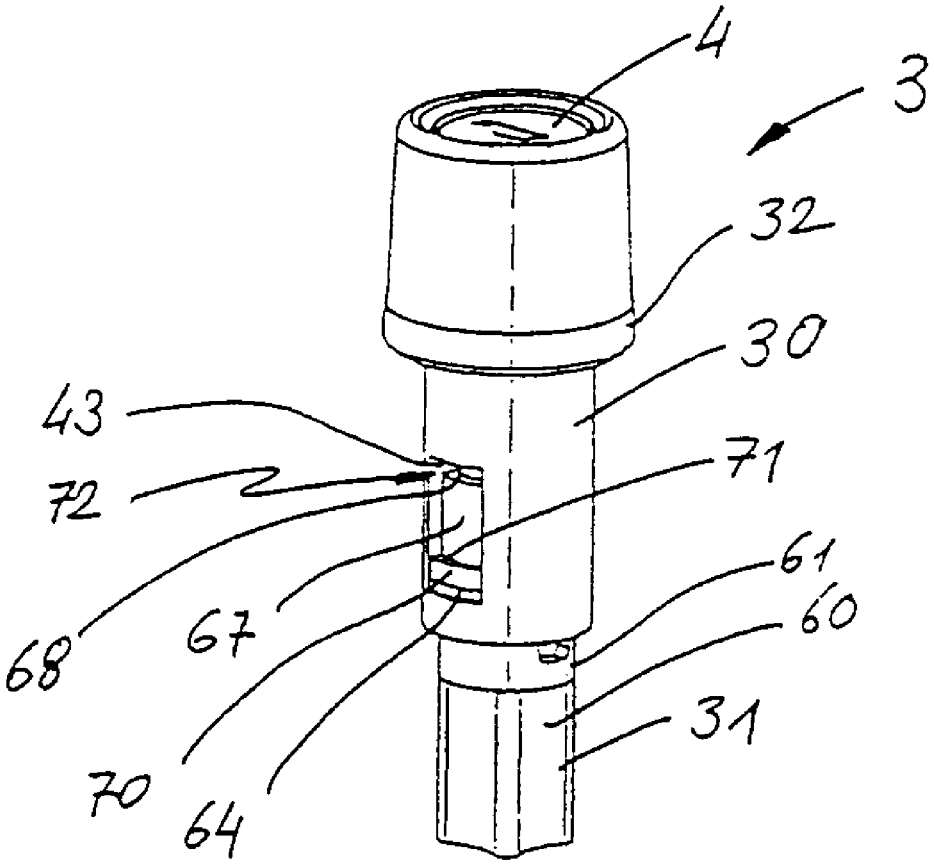
FIG. 4 shows a perspective assembly illustration of the pushbutton according to FIG. 3.

As best shown in FIG. 3, slide guide 66 has a base plate 75 which is essentially in the form of a circular disk and the outside diameter of which corresponds approximately to the inside diameter of the tube section 61. Spaced apart opposite one another, circular disk segments 76 are integrally formed on the base plate 75 and have an outside diameter which corresponds to the outside diameter of the tube section 61 or the inside diameter of the cylindrical tube section 32*a*. The circular disk sections 76 are of thicker design than the base plate 75 and have opposite, parallel, plane guide surfaces 77 which, together with the base plate 75, serve for the displaceable mounting of a slide 78 which will be described in more detail further below. The base plate 75 therefore forms, together with the guide surfaces 77, a cross-sectionally u-shaped guide groove for the slide 78.

Figure 10:
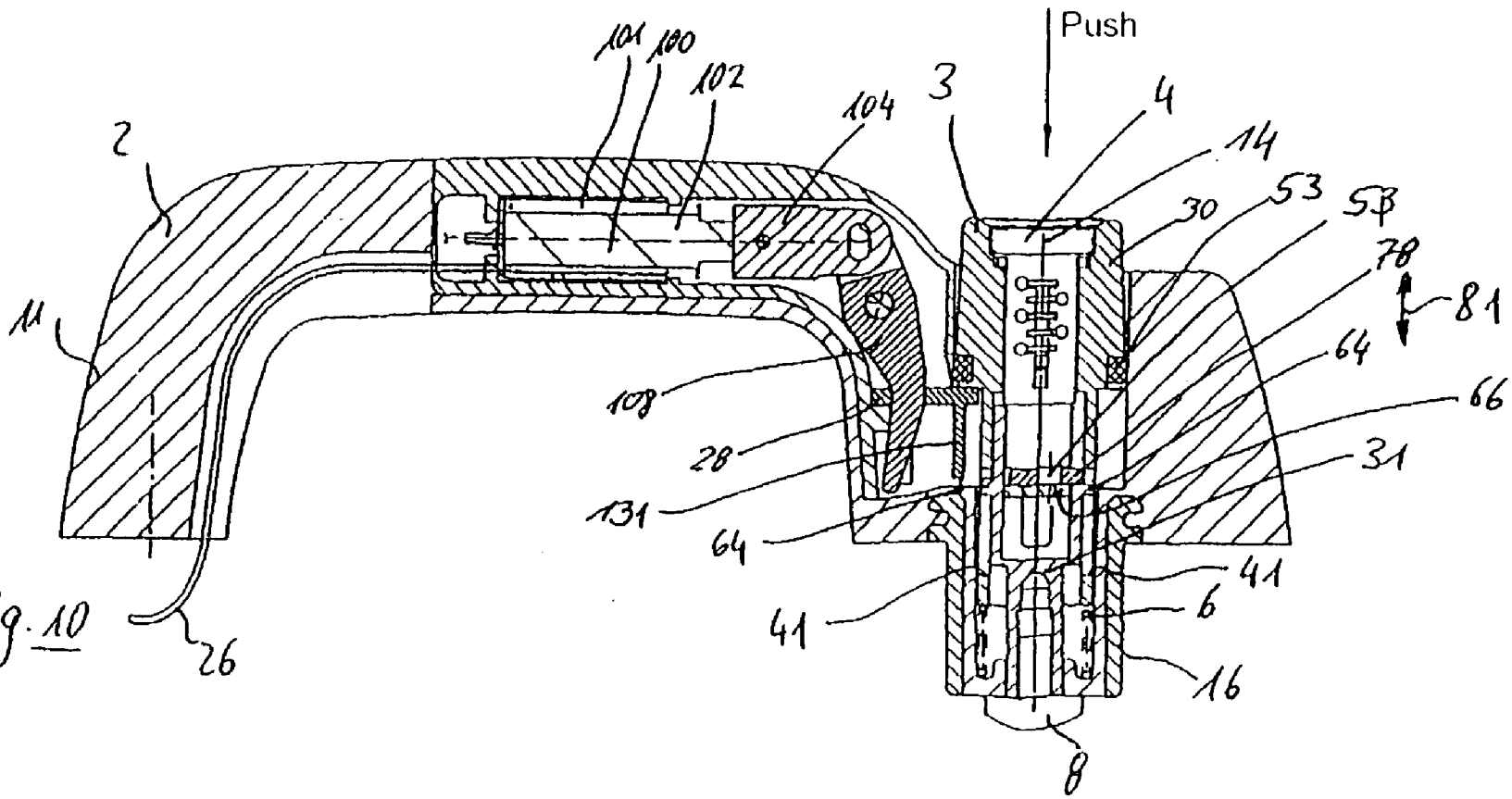
FIG. 10 shows the actuating apparatus according to FIG. 9 with the pushbutton actuated.

The slide 78 is a first coupling link and has a three-dimensional form essentially in the shape of a disk and has rectilinear, opposite guide edges 79 which interact with the guide surfaces 77, so that guiding of the slide 78 between the circular disk sections 76 is ensured. The end edges of the slide 78 are in the form of a circular arc. The outside diameter of the slide 78 between the end edges corresponds to the inside diameter of the cylindrical tube section 32*a*. A u-shaped recess 80 extends from one of the guide edges 79 into the interior of the slide 78. In the assembly, the eccentric nipple 53 of the lock cylinder 4 engages in this u-shaped recess 80. In the assembly, the slide guide 66 sits with the circular disk sections 76 on the end steps 65 of the tube section 61. As best shown in FIG. 10, the slide guide 66 can be displaced together with the slide 78 or the pushbutton lower part 31 in a double arrow direction or axial direction 81, the slide guide 66 being guided along the free side edges 69 of the stop tab 67.

Figure 5:
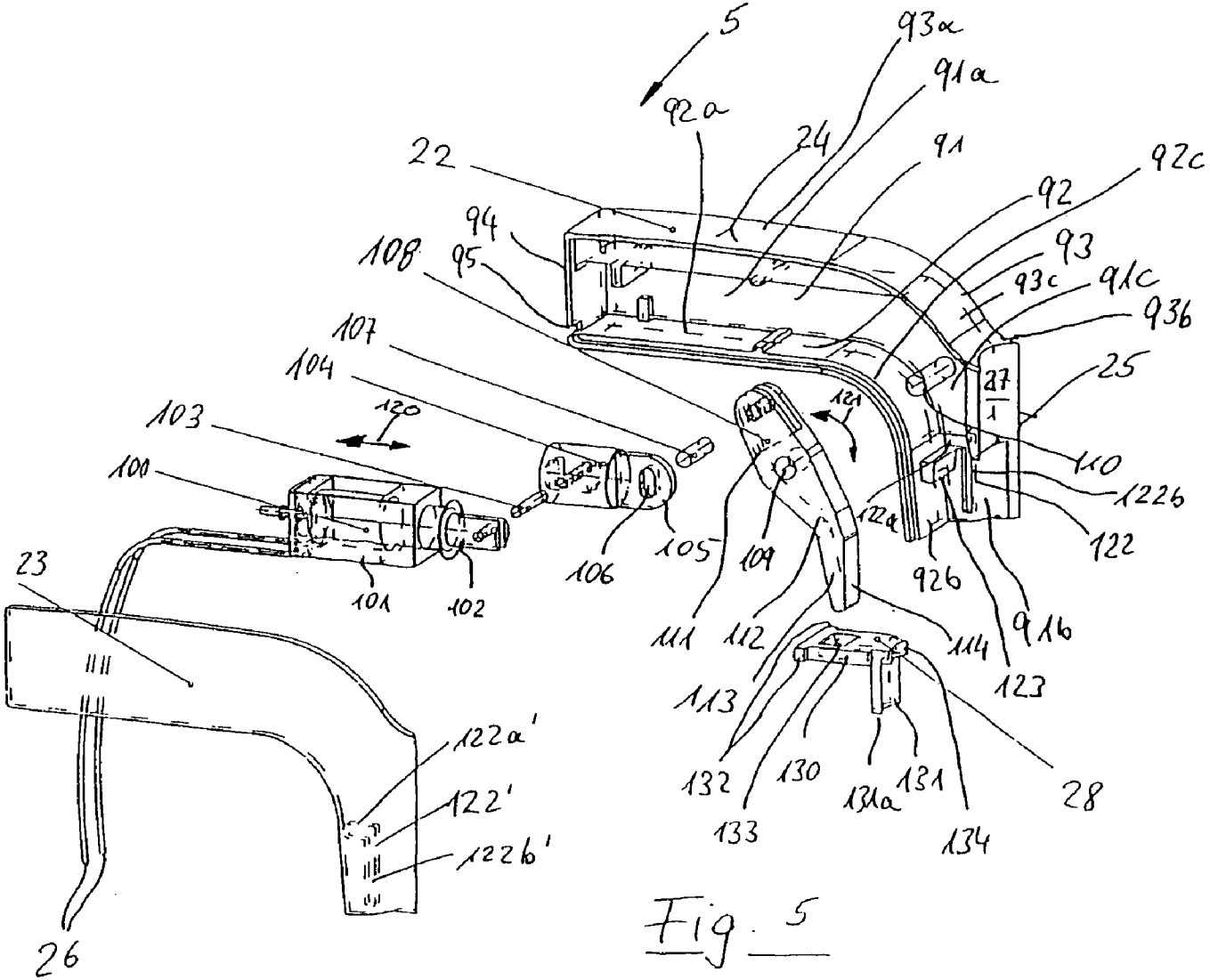
FIG. 5 shows a perspective exploded illustration of a locking device of the actuating apparatus according to the invention according to FIG. 1.
Figure 6:
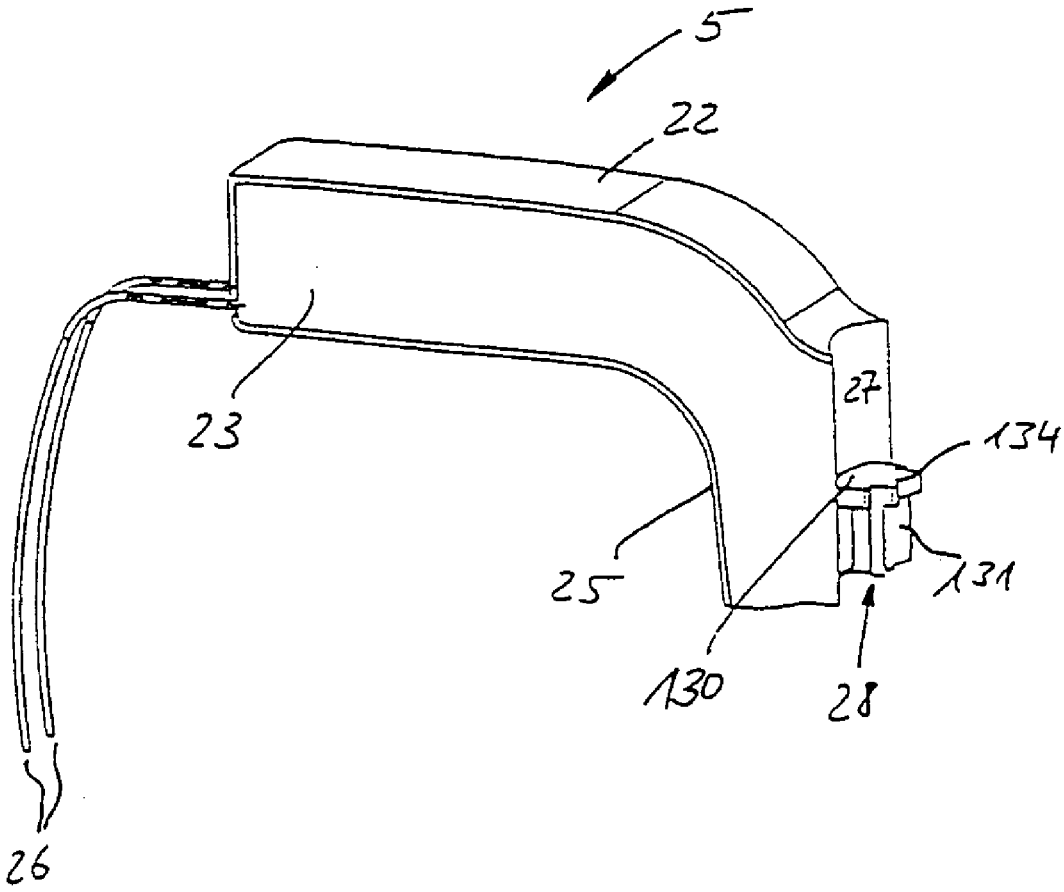
FIG. 6 shows the locking device according to FIG. 5 in a perspective assembly illustration.

The construction of the locking device 5 according to the invention will be described in detail below with reference to FIGS. 5 and 6.

The housing main part 22 has a three-dimensional shape which, as viewed from the side, is essentially L-shaped and U-shaped in cross section, with a housing base wall 91, a first, L-shaped side wall 92 and a second, L-shaped side wall 93 and an end side wall 94. The second side wall 93 has the outer surface 27 in the region of the plug-in opening 15, which outer surface, together with the plug-in opening 15, forms a cross-sectionally circular passage. The base housing wall 91 has, in the region of the first L-limb 24, a first, long base wall section 91*a* and, in the region of the second L-limb 25, a second, short base wall section 91*b*. The base wall sections 91*a* and 91*b* merge one in the other with a base wall curved section 91*c*.

The first side wall 92 has a first, long side wall section 92*a* in the region of the first L-limb 24, a second, short side wall section 92*b* in the region of the second L-limb 25 and a side wall curved section 92*c* in between. The second side wall 93 has a first, long side wall section 93*a* in the region of the first L-limb 24, a second, short side wall section 93*b* in the region of the second L-limb 25 and a side wall curved section 93*c* in between, the first, long side wall section 93*a* and the side wall curved section 93*c* together in the assembly forming a surface which is aligned with the surface of the handle body 2.

In the assembly, the end side wall 94 bears flush against the free end 18 of the blind-hole recess 17. The end side wall 94 has, in the region of the side wall 92, two recesses 95 through which the electric lines 26 can be led out of the housing interior.

A motor axial drive 100, for example a lifting magnet with a magnet body 101 and a piston rod 102, which is guided in a central hole and protrudes out of the hole, is arranged in the region of the first L-limb 24. The piston rod 102 is connected outside the magnet body 101 via a transverse pin 103 to a drag lever or drag arm 104 which sits in front of the head on the piston rod. The drag lever 104 has, in the region of its free end 105, a slot-type recess 106 which extends perpendicularly with respect to the longitudinal extent and in which is mounted a pin 107 which extends transversely with respect thereto and via which the drag lever 105 is connected to a first lever arm 111 of a two-armed reversing lever 108. The reversing lever 108 has a hole 109 with which it is mounted pivotably on an axis 110 which extends away vertically from the base wall 91 in the region of the base wall curved section 91*c*. The reversing lever 108 has a second lever arm 112 lying opposite the first lever arm 111. The axial drive 100, the drag lever 104 and the first lever arm 111 of the reversing lever 108 are arranged in the region of the first L-limb 24 of the housing 21. The second lever arm 112 of the reversing lever 108 protrudes from the axis 110 into the second L-limb 25 of the housing 21. The reversing lever 108 has an actuating section 113 in the region of the free end of the second lever arm 112. The actuating section 113 tapers toward the free end and has a sliding surface 114 which points in the assembly toward the plug-in opening 15. Axial extension of the axial drive 100 in a direction 120 causes the reversing lever to pivot via the drag lever 104 about the axis 110 in a direction 121.

The second base wall section 91*b* has a rectangular, L-shaped angled groove 122 with a short first groove limb 122*a* and a long second groove limb 122*b*. The first groove limb 122*a* runs parallel to the actuating direction 120 of the axial drive 100. The second groove limb 122*b* runs parallel to the actuating longitudinal axis 14. At the free end of the first groove limb 122*a*, the latter ends in the transition region between the base wall section 92*c* and the second side wall section 92*b* of the side wall 92. A stop console 123 for the slide 28, which will be described further below, is integrally formed, laterally aligned with the groove limb 122*a*, on the inside of the second side wall section 92*b*. Opposite the second side wall section 92*b*, the side wall section 93*b* has, below the outer surface 27, a recess from which the slide 28 protrudes.

The slide 28 is a further coupling link and has a slide plate 130 and a stop tab or stop web 131 which, perpendicularly from the slide plate 130, extends away from the end of the slide plate 130 in the region of one end thereof. The stop tab 131 has a free edge 131*a* and has a width which is smaller than or equal to the clear width of the window-type cutouts 40. In the region of the other end of the slide plate 130, a projection 132 is integrally formed on each side of the slide plate 130. In the assembly, the projections 132 run in the angled groove 122, i.e. they are in engagement with the angled groove limbs 122*a* and 122*b*. Opposite the angled groove 122 in the base wall 91, an angled groove 122' with a first angled groove limb 122*a*' and a second angled groove limb 122*b*' is likewise formed in the cover 23. The angled grooves 122 and 122' serve for guiding the slide 130. In an operating position, the slide plate 130 rests on the supporting console 123. The slide plate 130 furthermore has an essentially square reach-through window 133 through which the free end 113 of the reversing lever 108 reaches. The stop tab 131 of the slide 28 has a three-dimensional shape which is in the form of a cylindrical tube wall and the inside diameter of which corresponds approximately to the outside diameter of the tube section 61 and the outside diameter of which corresponds approximately to the outside diameter of the cylindrical tube section 32*a*. As an extension of the slide plate 130, a slide projection 134 which has a channel in the form of a circular arc at its free end extends beyond the stop tab 131, the channel approximately corresponding in respect of its diameter to the inside diameter of the tube section 61.

The housing 21, in which the axial drive 100, the drag lever 104, the reversing lever 108 and the slide 28 are mounted, therefore form the locking device 5 which can be inserted into the handle body 2 in the manner of a module or cassette.

The assembly of the actuating apparatus 1 according to the invention will be described in more detail below with reference to FIG. 7 as a supplement to the previous description.

In the assembly, the compression spring 6 at one end is supported on a base wall of the receiving device 16 and at the other end rests against the annular end surface 35 of the cylindrical tube section 32*a* of the pushbutton upper part 30. The pushbutton lower part 31 is connected by means of the previously described clip connection to the pushbutton upper part 30 in a manner such that they can be displaced axially in the direction 81. The pushbutton upper part 30 is mounted in the handle body 2 by means of the sealing ring 32 in the plug-in opening 15 in interaction with the outer surface 27. The pushbutton lower part 31 reaches through a hole in the base wall of the receiving device 16 and is connected to the actuating element 8. The reversing lever 108 reaches with its 113 through the slide plate 130 of the slide 28, the slide 28 being guided in the grooves 122, 122', in the housing 21. The window-type cutouts 40 of the pushbutton 3 are arranged in such a manner that the window-type cutout 40, in which the stop tab 67 of the pushbutton lower part 31 is arranged, lies opposite the slide 28. The slide 78, which can be actuated manually via the lock cylinder 4, is in engagement with the eccentric nipple 53 of the lock cylinder 4 and can be displaced to and fro by means of the eccentric nipple 53 in a direction perpendicular with respect to the axis 14, for example by rotation of the lock cylinder 4 by a key.

In the following, a first operating position ("central locking system or locking device 5 open") will be described with reference to FIGS. 7 and 8. In the position according to FIG. 7, the pushbutton 3 is not actuated and, in the position according to FIG. 8, it is actuated, i.e. pushed in.

Figure 7:
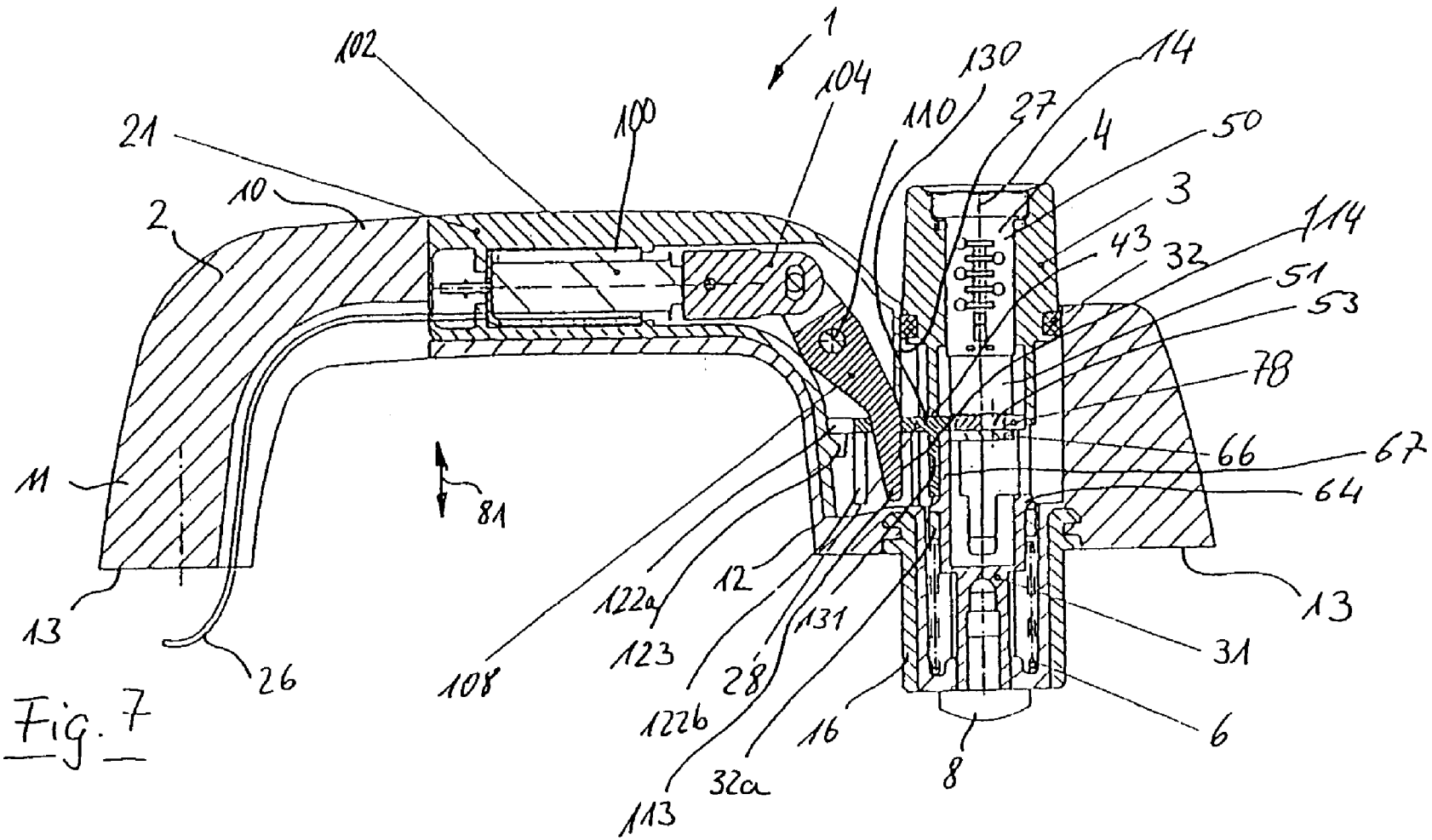
FIG. 7 shows a longitudinal section through the actuating apparatus according to FIG. 1 in a first operating position with the pushbutton not actuated.
Figure 8:
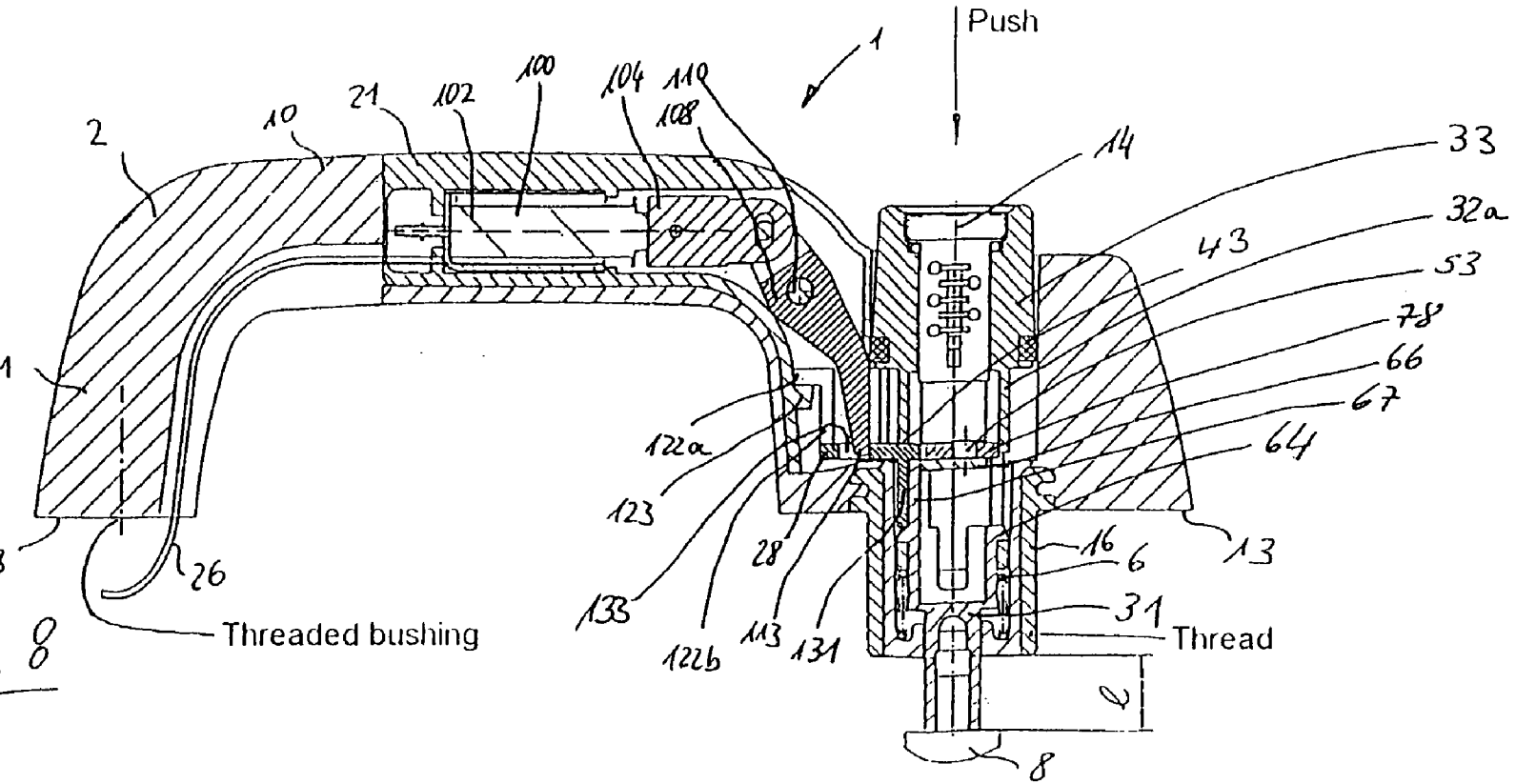
FIG. 8 shows the actuating apparatus according to FIG. 7 with the pushbutton actuated.

According to FIG. 7, the axial drive 100, i.e. the lifting magnet, is energized, so that the piston rod 102 is drawn in. In this position, the second lever arm 112 of the reversing lever 110 is positioned in such a manner that the sliding surface 114 is oriented parallel to the actuating longitudinal axis 14. The slide 28 sits with its guide projections 132 in the corner region of the angled groove 122, so that the stop tab 131 of the slide 28 comes to bear against the stop tab 67 of the pushbutton lower part 31 and the free end edge 131*a* rests on the upper side 71. Furthermore, the upper edge 43 of the window-type cutout 40, which faces the slide 28, in the pushbutton upper part 30 sits on the slide plate 130. In addition, the projection 134 rests on the free end edge 68 of the stop tab 67. The pushbutton upper part 30 is therefore connected to the pushbutton lower part 31, in a manner coupled in a form-fitting manner via the slide 28, said pushbutton lower part 31 in turn being connected in a form-fitting manner to the actuating element 8, so that pressing on the compressive part 33 according to FIG. 8 causes the pushbutton upper part 30 together with the slide 28 and the pushbutton lower part 31 and the actuating element 8 to be displaceable by the length l, as best shown in FIG. 8. In this position, the slide 28 with its projections 132 is situated at the free end of the second groove limb 122*b* or 122*b*'. The compression spring 8 is compressed. Release of the compressive part 33 causes the compression spring 6 to expand and to bring the pushbutton 3 back into the starting position according to FIG. 7. Extension of the actuating element 8 by the length l causes a lock mechanism to be actuated (not illustrated).

Figure 9:
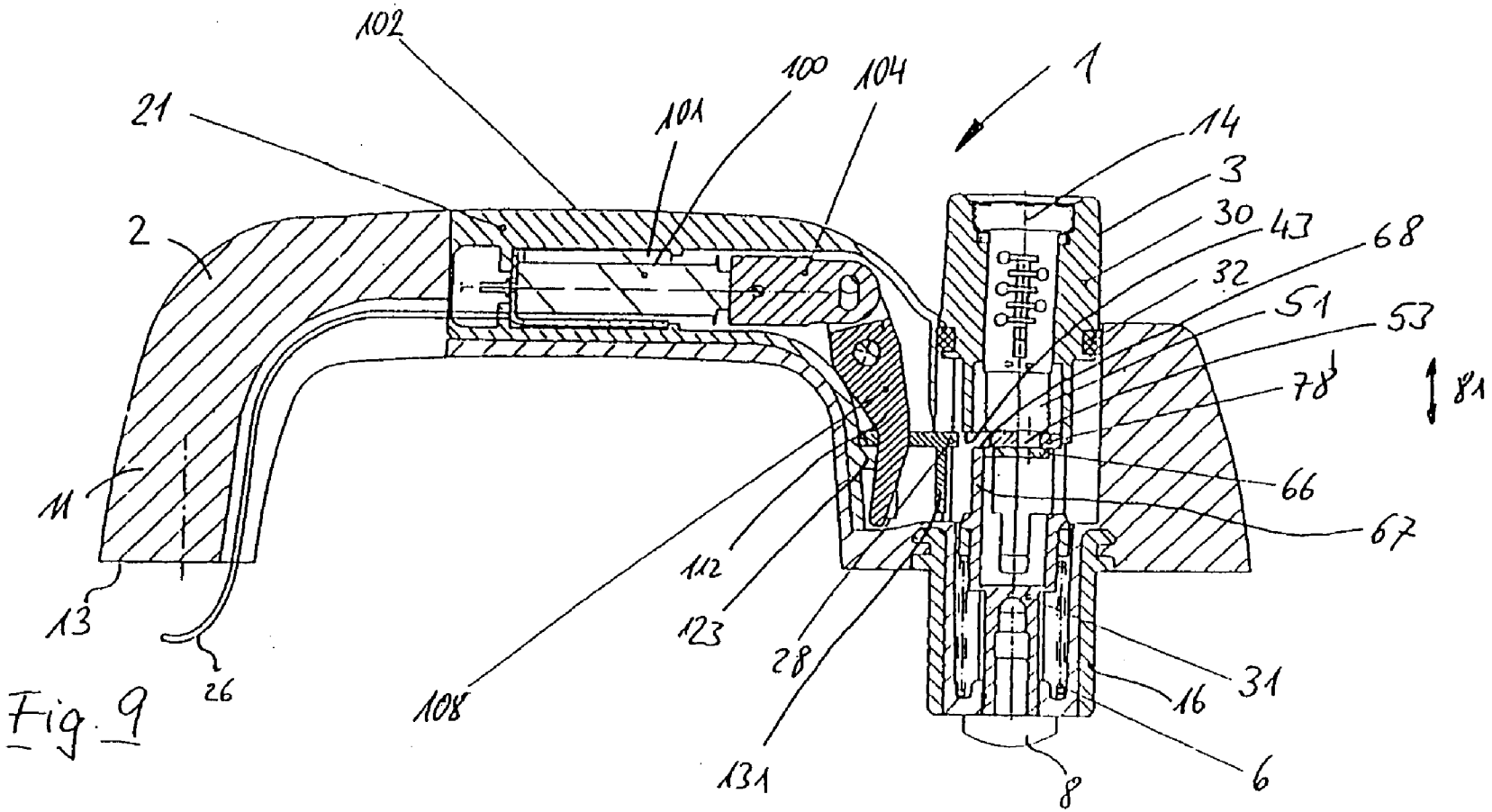
FIG. 9 shows a longitudinal section through the actuating apparatus according to the invention in a second operating position with the pushbutton not actuated.

In the second operating position according to FIGS. 9 and 10 (when the locking system is closed), the axial drive 100 or the lifting magnet 101 is connected currentlessly, so that the rod 102 is extended. The actuating second lever arm 112 of the reversing lever 108 is pivoted toward the console 123 and bears against the console 123. During the pivoting, it has carried along the slide 28 which, in the retracted position, rests in the free end of the groove limb 122*a*, with the slide plate 130 resting on the console 123. In this position, the stop tab 131 of the slide 28 is arranged spaced apart from the stop tab 67 of the pushbutton lower part 31, so that the upper edge 43 of the window facing the slide 28 is exposed. Otherwise, all of the remaining components of the actuating apparatus 1 are in the position according to FIG. 7. When the pushbutton 3 is actuated by being pressed in the arrow direction according to FIG. 10, in this operating position there is no form-fitting or frictional connection between the pushbutton upper part 30 and the pushbutton lower part 31, so that the pushbutton upper part 30 can be displaced in the axial direction 14 relative to the pushbutton lower part 31. The pushbutton upper part 30 and the pushbutton lower part 31 are mechanically decoupled. The pushing according to FIG. 10 therefore merely causes the pushbutton upper part 30 to be displaced axially, so that the compression spring 6 is compressed. The pushbutton lower part "remains" in its starting position according to FIG. 9, so that an actuation of a lock mechanism (not shown) by the actuating element 8 does not occur and an extension of the actuating element 8 by the length l is therefore prevented. In this "empty stroke", the latching projections 64 are lifted off from the lower edges 41. The latching projections 64 and the supporting projection 70 are guided between the side edges 42 of the window-type cutouts 40 in the cylindrical tube section 32*a* and are displaced relative to the pushbutton upper part 30. Release of the pushbutton 3 enables the pushbutton upper part to be displaced by the compression spring 6 back into the starting position according to FIG. 9. In this position, an opening of a motor vehicle door or of the motor vehicle flap (not illustrated) is therefore not possible, since the actuating element 8 is mechanically decoupled from the pushbutton upper part 3.

In the operating position of the locking device 5 according to FIGS. 9 and 10, i.e. the operating position "central locking system closed", the 3, including the pushbutton upper and lower parts 30 and 31, can be mechanically coupled manually in a conventional manner by inserting the key into the lock cylinder 4 and rotating the same. After the key has been inserted into the lock cylinder 4, the rotating body 51 is rotatable. Rotation of the rotating body 51 about the axis 14 causes the eccentric nipple 53 to be moved from the position according to FIG. 9 (on the right of the longitudinal axis 14) into an open position (on the left of the longitudinal axis 14 (not shown)). By this means, the slide 78 is displaced from its position shown in FIG. 9 to the left, so that it comes to lie over the free edge 68 of the stop tab 67 of the pushbutton lower part 31. In this case, it can also displace the slide 28 if the latter is in the position according to FIG. 7 because the locking device 5 is preferably set up in such a manner that it can be displaced. In this position, pushing of the pushbutton 3 causes the actuating element 8 to be actuated, since the pushbutton upper part 30 is mechanically coupled to the actuating element 8 via the lock cylinder 4, the slide 78 and the stop tab 67 of the pushbutton lower part 31. An actuation of the lock can therefore be achieved purely manually even, for example, if the current should fail.

In the case of the actuating apparatus according to the invention, it is particularly advantageous that the latter is of particularly compact construction and permits the manual closing and opening and also a remotely actuable opening and closing. A further particular advantage is that the electrically controllable locking device 5 is designed in the manner of a module or cassette and is inserted into the handle body, and a variation of the actuating apparatus with and without a remote-controllable unlocking functionality can therefore be realized in a simple manner. By means of omission of the locking device 5 and by means of a simple closing of the slot-type recess in the handle body 2 by a cover or a panel (not shown), the actuating apparatus according to the invention can optionally be designed with and without a remote-triggering functionality. A costly installation, for example in a door body of a motor vehicle, as conventionally takes place, is unnecessary.

While the above description constitutes the preferred embodiment of the present invention, it will be appreciated that the invention is susceptible to modification, variation and change without departing from the proper scope and fair meaning of the accompanying claims.

The invention claimed is:

1. An actuating apparatus for a lock mechanism comprising:

a handle body, wherein the handle body is a substantially U-shape design, the handle body having a base limb, a first U-limb and a second U-limb, which are connected permanently with each other;

an actuating device for driving an actuating element for the lock mechanism being mounted in the second U-limb, a moveable coupling link being provided, with which the actuating device can be brought out of operation wherein the coupling link, is connected driveably to a locking device having a remote-controllable driving device; and the locking device is accommodated in the base limb of the handle body.

2. The actuating apparatus of claim 1, wherein the movable coupling link is a slider.

3. The actuating apparatus of claim 1, further comprising a manually actuable coupling link.

4. The actuating apparatus of claim 1, wherein the driving device is an axial drive.

5. The actuating apparatus of claim 4, wherein the driving device is a lifting motor.

6. The actuating apparatus of claim 5, wherein the driving device is a lifting-magnet drive.

7. The actuating apparatus of claim 1, wherein the driving device is connected to the coupling link via a pivotable reversing lever.

8. The actuating apparatus of claim 7, wherein a drag arm is connected between the reversing lever and the driving device.

9. The actuating apparatus of claim 8, wherein the driving device with the lever arm and the drag arm and the coupling link are accommodated in a housing, and the housing is arranged in the handle body.

10. The actuating apparatus of claim 1, wherein the actuating device further comprises a pushbutton with a lock cylinder, the lock cylinder having an actuating longitudinal axis as longitudinal movement axis.

11. The actuating apparatus of claim 10, wherein the handle body, the pushbutton with the lock cylinder, the locking device, and the actuating element are acted upon by a compression spring.

12. The actuating apparatus as claimed in claim 10, wherein the U-limbs each having end sides with which the handle body can be fastened along an actuating longitudinal axis, a plug-in opening for the pushbutton and the plug-in opening completely penetrates the second U-limb, and a receiving device having an essentially cylindrical outer shape extends away from the end side of the second U-limb.

13. The actuating apparatus as claimed in claim 12, wherein an elongated blind-hole recess extends away from the plug-in opening, and opening into the latter, and said blind-hole recess is connected in the region of its end lying opposite the plug-in opening to a groove-type depression, which extends from an inside of the base limb and of the first U-limb as far as the end side of the first U-limb; and the groove-type depression is capable of being covered or can be closed by means of a covering, which is of essentially L-shape design with a first covering limb and a second covering limb.

14. The actuating apparatus of claim 13, wherein the locking device is designed in the manner of a plug-in module for plugging into the blind-hole recess of the handle body and further comprises a housing with a housing part and a housing cover, the housing is of essentially L-shaped design and has a first limb which corresponds to the blind-hole recess in the base limb and a second limb, which corresponds to the blind-hole recess in the region joining the latter to the plug-in opening.

15. The lines actuating apparatus as claimed in claim 14, further comprising electrical lines at the free end of the first limb, the electrical lines lead off to an electric control element.

16. The actuating apparatus of claim 14, wherein the second limb further comprises toward the plug-in opening, an outer surface which is designed in the shape of a section of a cylinder, such that the plug-in opening together with the outer surface is circular in cross section, with the movable coupling link being a slider projecting from the outer surface of the locking device for a distance into the plug-in opening.

17. The actuating apparatus of claim 12, wherein the pushbutton comprises a pushbutton upper part and a pushbutton lower part, the lock cylinder being inserted in the pushbutton upper part by means of a clip connection and the pushbutton upper part has a sealing ring which interacts with the inside of the plug-in opening and seals off the gap between the pushbutton upper part and the plug-in opening.

18. The actuating apparatus of claim 17, wherein the pushbutton upper part has a cylindrical tube section and a compressive part, the cylindrical tube section being a thin-walled, cylindrical tube with a tube outside and a free annular end surface, and, opposite the annular end surface, the compressive part being connected integrally to the cylindrical tube section, and the compressive part is larger in outside diameter than the cylindrical tube section and has a stepped hole with the actuating longitudinal axis as the central axis, the stepped hole having grooves on the inside for receiving small lock plates of the lock cylinder.

19. The actuating apparatus of claim 18, wherein the cylindrical tube section has two window-type cutouts which lie opposite each other in each case, with a lower edge, two side edges and an upper edge, the two window-type cutouts having the same extent in terms of area, and the lower edge and the upper edge each being arranged parallel to the annular end surface, with the side edges being arranged parallel to the actuating longitudinal axis.

20. The actuating apparatus of claim 10, wherein the lock cylinder has a blocking body and a rotating body, with small lock plates being mounted in the blocking body; the blocking body having a tumbler; and the rotating body has, eccentrically with respect to the actuating longitudinal axis, an eccentric nipple which protrudes for a distance in the axial direction from the rotating body.

21. The actuating apparatus of claim 19, wherein the pushbutton lower part comprises a punch section and a tube section, the punch section having, along the actuating longitudinal axis, at the free end of the punch section a threaded hole for receiving the actuating element, and the tube section having an outside diameter which corresponds to the inside diameter of the cylindrical tube section of the pushbutton upper part and the tube section extends away for a distance from the punch section and, corresponding to the window-type cutouts, has latching projections which are dimensioned with regard to their three-dimensional shape, in such a manner that they can interact with the lower edge of the window-type cutouts and which with regard to the width, are dimensioned in such a manner that they can be moved up and down in the window-type cutouts, guided by the side edges.

22. The actuating apparatus of claim 21, wherein adjacent to the latching projections, the tube section has end steps situated lower down, the end steps serving to support a slide guide and wherein aligned in the longitudinal direction, one of the latching projections has a stop tab as an extension of the tube section, the stop tab having a three-dimensional shape in the form of a section of a cylindrical tube, and having a free end edge and side edges and directly in the longitudinal direction adjacent to the associated latching projection, the stop tab has a stepped shoulder which has a step upper side in the form of a section of a circular ring.

23. The actuating apparatus of claim 22, wherein in the assembly of the pushbutton upper part and the pushbutton lower part, the stepped shoulder is situated in one of the windows of the pushbutton upper part and the axial extent of the stop tab is dimensioned such that when a latching projection bears against the lower edge of the window, there is an axial distance between the free end edge and the upper edge, forming a gap.

24. The actuating apparatus of claim 22, wherein the slide guide has a base plate which is substantially in the form of a circular disk and the outside diameter of which corresponds approximately to the inside diameter of the tube section, and, spaced apart opposite one another, circular disk segments are integrally formed on the base plate, the circular disk sections are of thicker design than the base plate and have opposite, parallel guide surfaces which, together with the base plate, serve for the displaceable mounting of a manually actuable coupling link being a slider, and the manually actuable slider has a three-dimensional form essentially in the shape of a circular disk and has flattened, opposite end edges which Interact with the guide surfaces, so that guiding of the slider between the circular disk sections is ensured, a U-shaped recess extends from one of the flattened edges into the interior of the slider and the lock cylinder having an eccentric nipple engaging in assembly in this U-shaped recess.

25. The actuating apparatus of claim 14, wherein the housing part has a three-dimensional shape which is essentially L-shaped and channel-shaped, with a housing base wall, a first, L-shaped side wall and a second, L-shaped side wall and an end side wall, the second side wall having the outer surface in the region of the plug-in opening, and the base wall has, in the region of the first limb, a first base wall section and, in the region of the second limb, a second base wall section, which base wall sections are connected to a base wall curved section, and the first side wall has a first side wall section in the region of the first limb, a second side wall section in the region of the second limb and a side wall curved section in between, and the second side wall has a first side wall section in the region of the first limb, a second side wall section in the region of the second limb and a side wall curved section in between, the first side wall section and the side wall curved section together in an assembly forming a surface which is aligned with the surface of the handle body.

26. The actuating apparatus of claim 14, wherein the driving device essentially comprising a motor axial drive which is a lifting magnet with a magnet body and a piston rod is arranged in the region of the first limb, the piston rod being connected via a transverse pin to a drag lever, and the drag lever has, in the region of its free end, a slot-type recess in which a pin is mounted via which the drag lever is connected to a reversing lever, the reversing lever having a hole with which it is mounted pivotably on an axis which extends away vertically from a base wall in the region of a base wall curved section, and where the reversing lever has a first lever arm and a second lever arm, the second lever arm of the reversing lever protruding from the axis into the second limb of the housing.

27. The actuating apparatus of claim 26, wherein in the case of the axial drive, the drag lever and the first lever arm of the reversing lever are arranged in the region of the first limb of the housing.

28. The actuating apparatus of claim 26, wherein the reversing lever has an actuating section in the region of the free end of the second lever arm, the actuating section tapering toward the free end and having a sliding surface which points in the assembly toward the plug-in opening.

29. The actuating apparatus of claim 26, wherein a second base wall section has an angled groove with a first groove limb and a second groove limb, the first groove limb running parallel to one actuating direction of the axial drive and the second groove limb running parallel to the actuating longitudinal axis and at the free end of the first groove limb, the latter ends in the transition region between a base wall section and a second side wall section of a side wall and a stop console for a slide is arranged aligned with the first groove limb on inside of a second side wall section.

30. The actuating apparatus of claim 25, wherein, opposite the second side wall section, a second side wall section has, below the outer surface, a recess from which a movable slider protrudes.

31. The actuating apparatus of claim 2, wherein the slider has a slide plate and a stop tab which, vertically from the slide plate, extends away vertically from the end of the slide plate in the region of one end thereof, and a pushbutton having a pushbutton upper part with a cylindrical tube section having windows and the stop tab has a free edge and has a width which is smaller than or equal to the clear width of the windows, and in the region of the other end of the slide plate, projections which in the assembly run in an angled groove are integrally formed on the slide plate.

32. The actuating apparatus of claim 29, wherein opposite the angled groove in the base wall, an angled groove with a first angled groove limb and a second angled groove limb is likewise formed in the cover.

33. The actuating apparatus of claim 28, and a moveable coupling link is as slider having a slide plate which has an essentially square reach-through window through which the free end of the reversing lever reaches.

34. The actuating apparatus of claim 31, wherein as an extension of the slide plate, a slide projection which has a channel in the form of a circular arc at its free end extends beyond the stop tab.

35. The actuating apparatus of claim 9, wherein a housing, in which the driving device, the drag arm, the reversing lever and the moveable coupling link being a slider are mounted, form the locking device which can be inserted into the handle body in the manner of a module or cassette.

36. The actuating apparatus of claim 18, wherein the actuating element acts upon a compression spring which at one end bears against a base wall of the receiving device and at the other end rests against the annular end surface of the cylindrical tube section of the pushbutton upper part.

37. The actuating apparatus of claim 17, wherein the pushbutton lower part is connected by means of a clip connection to the pushbutton upper part in a manner such that they can be displaced axially in one direction with respect to each other.

38. The actuating apparatus of claim 16, wherein the pushbutton having an upper part with a sealing ring, a pushbotton upper part being mounted in the handle body by means of the sealing ring and the plug-in opening in interaction with the outer surface.

39. The actuating apparatus of claim 17, wherein the pushbutton lower part reaches through a hole in the base wall of the receiving device and is connected to the actuating element.

40. The actuating apparatus of claim 32, wherein the moveable coupling link is a slider having a slide plate and wherein the reversing lever has an actuating section in the area of the free end of the second lever arm with which it reaches through the slide plate, the slider being guided in the grooves in the housing.

41. The actuating apparatus of claim 22, wherein the moveable coupling link is a slider and wherein the windows of the pushbutton are arranged in such a manner that a window, in which the stop tab of the pushbutton lower part is arranged, lies opposite the slider.

42. The actuating apparatus of claim 20, comprising a further, manually actuable coupling link which is a slider, wherein the manually actuable slider is in engagement with the eccentric nipple of the lock cylinder and can be displaced by said eccentric nipple.

43. The actuating apparatus of claim 1, wherein the actuating apparatus is used as a lock mechanism of a door of a motor vehicle.

44. The actuating apparatus of claim 1, wherein the actuating apparatus is used as a lock mechanism of a door of a tractor.

* * * * *

UNITED STATES PATENT AND TRADEMARK OFFICE

CERTIFICATE OF CORRECTION

PATENT NO. : 7,194,881 B2
APPLICATION NO. : 11/063345
DATED : March 27, 2007
INVENTOR(S) : Horst Kutschat It is certified that error appears in the above-identified patent and that said Letters Patent is hereby corrected as shown below:

In claim 9, column 9, line 5, delete “arm” between “lever” and “and”.

In claim 10, column 9, line 11, insert --a-- between “as” and “longitudinal”.

In claim 15, column 9, line 43, delete “lines” between “the” and “actuating”.

In claim 24, column 10, line 67, delete “Interact” and insert --interact--.

In claim 25, column 10, line 23, change “the” between “with” and “surface” to --a--.

In claim 33, column 12, line 11, delete “is” between “link” and “as”.

Signed and Sealed this

Twenty-ninth Day of May, 2007

JON W. DUDAS
*Director of the United States Patent and Trademark Office*